US008230601B2

(12) United States Patent
Shimizu

(10) Patent No.: US 8,230,601 B2
(45) Date of Patent: Jul. 31, 2012

(54) ROTARY ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 486 days.

(21) Appl. No.: 12/490,677

(22) Filed: Jun. 24, 2009

(65) Prior Publication Data

US 2009/0320294 A1 Dec. 31, 2009

(30) Foreign Application Priority Data

Jun. 27, 2008 (JP) ..... 2008-168806

(51) Int. Cl.
*B26B 19/04* (2006.01)
*B26B 19/14* (2006.01)

(52) U.S. Cl. ..... 30/43.4; 30/43.5; 30/43.6

(58) Field of Classification Search ..... 30/43.4–43.6
See application file for complete search history.

(56) References Cited

U.S. PATENT DOCUMENTS

| | | | | |
|---|---|---|---|---|
| 5,625,950 | A * | 5/1997 | Sterk et al. | 30/43.6 |
| 6,568,081 | B2 * | 5/2003 | Barish | 30/43.6 |
| 6,647,626 | B2 * | 11/2003 | Nakano | 30/43.4 |
| 6,823,590 | B2 * | 11/2004 | Uchiyama et al. | 30/43.6 |
| 6,868,611 | B2 * | 3/2005 | Geertsma et al. | 30/43.6 |
| 7,152,324 | B2 * | 12/2006 | Uchiyama | 30/43.6 |
| 7,222,428 | B2 * | 5/2007 | Koike | 30/43.5 |
| 7,269,902 | B2 * | 9/2007 | Van Der Meer | 30/43.6 |
| 7,370,420 | B2 * | 5/2008 | Shimizu | 30/43.4 |
| 7,401,407 | B2 * | 7/2008 | Miyasaka | 30/43.6 |
| 7,487,592 | B2 * | 2/2009 | Koike | 30/43.4 |
| 7,509,741 | B2 * | 3/2009 | Shimizu | 30/43.6 |
| 7,584,541 | B2 * | 9/2009 | Uchiyama | 30/43.4 |
| 7,603,777 | B2 * | 10/2009 | Shumizu | 30/43.6 |
| 7,743,508 | B2 * | 6/2010 | Shimizu | 30/43.6 |
| 7,845,078 | B2 * | 12/2010 | Shimizu | 30/43.5 |
| 2007/0089298 | A1 | 4/2007 | Shimizu | |
| 2007/0124936 | A1 * | 6/2007 | Okabe | 30/43.6 |
| 2007/0277379 | A1 | 12/2007 | Okabe | |
| 2008/0072429 | A1 * | 3/2008 | Uchiyama | 30/43.6 |
| 2008/0092393 | A1 * | 4/2008 | Van Der Meer | 30/43.6 |
| 2009/0320295 | A1 * | 12/2009 | Shimizu | 30/43.6 |
| 2010/0011589 | A1 * | 1/2010 | Van Der Borst et al. | 30/43.4 |

(Continued)

FOREIGN PATENT DOCUMENTS

EP 1683609 A1 * 7/2006

(Continued)

OTHER PUBLICATIONS

EP Communication, dated Nov. 12, 2009, issued in corresponding EP Application No. 09163892.4, 4 pages.

*Primary Examiner* — Jason Daniel Prone
(74) *Attorney, Agent, or Firm* — Sughrue Mion, PLLC

(57) ABSTRACT

The rotary electric shaver including; a plurality of cutter circumferential rims (24), each of which is detachable from the shaver main body (12), and separately surrounds and holds each of individual outer cutters (16), a pivotal supporting section (22) which pivotably retains the cutter circumferential rim on a pivotal axis passing the center of the outer cutter, and a detachable blind cover (66) which fills a gap between adjoining cutter circumferential rims and which is in resilient contact, from below, with a bottom edge of the cutter circumferential rim, the bottom edge being adjacent to the center of the shaver main body.

8 Claims, 9 Drawing Sheets

U.S. PATENT DOCUMENTS

| | | | | |
|---|---|---|---|---|
| 2010/0018058 | A1 * | 1/2010 | Brada et al. | 30/43.6 |
| 2010/0058594 | A1 * | 3/2010 | Westerhof et al. | 30/43.4 |
| 2011/0308088 | A1 * | 12/2011 | Brada et al. | 30/43.6 |

FOREIGN PATENT DOCUMENTS

| | | | | |
|---|---|---|---|---|
| EP | 1724073 | A1 | * | 11/2006 |
| EP | 1779983 | A1 | * | 5/2007 |
| EP | 2138283 | A1 | * | 12/2009 |
| EP | 2138284 | A1 | * | 12/2009 |
| JP | 09-503424 | | | 4/1997 |
| JP | 2006198093 | A | * | 8/2006 |
| JP | 2006320459 | A | * | 11/2006 |
| JP | 2007-117190 | A | | 5/2007 |
| JP | 2007117190 | A | * | 5/2007 |
| JP | 2007-151925 | A | | 6/2007 |
| JP | 2007-319339 | A | | 12/2007 |
| JP | 2010005189 | A | * | 1/2010 |
| JP | 2010005190 | A | * | 1/2010 |
| WO | 2006/067710 | A1 | | 6/2006 |

* cited by examiner

ROTARY ELECTRIC SHAVER

BACKGROUND OF THE INVENTION

1. Field of the Invention

The present invention relates to a rotary electric shaver which rotatively drives inner cutters, which are in resilient contact with inner bottom surfaces of circular outer cutters.

2. Description of the Related Art

There has been known a so-called rotary electric shaver which has circular or disk-shaped outer cutters and inner cutter rotating on the inner side of the outer cutters so that beard hair entering the hair introduction slits formed in the outer cutters is cut by the rotating inner cutters. As this type of electric shaver, there has been known in which outer cutter installing holes are formed in an outer cutter frame secured to a shaver main body and circular outer cutters are supported in the outer cutter installing holes such that the outer cutters are slightly movable in a vertical direction and slightly inclinable with respect to the outer cutter frame.

However, the aforesaid construction provides the outer cutters with a limited movable range relative to the outer cutter frame, thus presenting a problem in that the close contact between the outer cutters and skin is restricted with resultant unsatisfactory shaving feeling or inadequate user-friendliness. It has been proposed, therefore, to provide a rim which is movable relative to the main body (the rim being also referred to as an outer cutter rim, an cutter circumferential rim, a skin supporting rim or a skin protecting rim) between the outer cutters and the main body (the outer cutter frame) so as to expand the movable range and the inclinable range of the outer cutters.

JP 9-503424(T) (corresponding to WO 96/02368, U.S. Pat. No. 5,625,950 and EP 0719203) discloses a shaving apparatus which has a skin supporting rim (6) provided between an outer cutter and a main body (an outer cutter frame and a holder 2). The outer cutter is held by the rim such that it is slightly movable in a vertical direction and also slightly inclinable, and the outer periphery of the rim is pivotally supported by the outer cutter frame of the main body. More specifically, the rim enters a circular opening of the outer cutter frame, and a pair of projections provided on the outer periphery of the rim is engaged with the inner peripheral surface of the opening provided in the outer cutter frame. In other words, a pivotal supporting section is disposed between the outer periphery of the rim and the opening of the outer cutter frame. Further, adjoining rims are hinge-connected (e.g., by a tongue-and-groove joint). It has been required, therefore, to form the linear joint of the adjoining rims. In addition, the restoring force of an inclined rim has been imparted by an upward force of an inner cutter drive shaft or the force of restoration (the force for restoring from an inclination) of an inner cutter drive shaft to the upright position thereof.

JP 2007-151925(A) (corresponding to US 2007-124936 (A1)) discloses a shaving apparatus in which the upper surface of a shaver main body (a head bottom plate) is provided with an upright wall (a supporting section 54) surrounding a cutter circumferential rim (cutter frame 18) holding an outer cutter, and each cutter circumferential rim is independently and pivotally retained to the upright wall. In other words, the upper surface of the shaver main body (the head bottom plate) is exposed between the cutter circumferential rims.

JP 2007-117190(A) (corresponding to US 2007-089298 (A1) and EP 1779983A1) discloses a shaving apparatuses in which a cutter unit (16) consisting of an assembly of an outer cutter and an inner cutter is pivotally retained in an outer cutter mounting aperture (20) formed in an outer cutter frame (18), which is openable/closable or detachable relative to a shaver main body.

JP 2007-319339(A) (corresponding to US 2007-277379 (A1) and EP 1862271A1) discloses a shaving apparatus in which an outer cutter frame (20) fixed to a shaver main body is provided with an outer cutter mounting hole (22) for mounting each cutter unit (18), a slit (50) extending toward the center of the shaver main body from an outer periphery is formed between adjoining outer cutter mounting hole (22), and a portion surrounding each of outer cutters (14) partitioned by the slit (50) is inclinable or bendable.

According to the shaving apparatus disclosed in JP 9-503424(T) (corresponding to WO 96/02368, U.S. Pat. No. 5,625,950, and EP 0719203), the adjoining cutter circumferential rims (the skin supporting rims) are hinge-connected, so that the joint portion is linear, thus restricting the shapes or placements of the cutter circumferential rims.

Further, pressing or depressing one cutter circumferential rim against the skin and inclining the cutter circumferential rim on the skin causes all cutter circumferential rims to be interlockingly pressed and tilted, resulting in an increase in a pressing force (depressing start pressure or an inclination start pressure) of each cutter circumferential rim. The pressing force or the inclining start pressure is set by an upward force or a force of an inner cutter drive shaft to restore from an inclination. The contact pressure applied by the inner cutter to the outer cutter cannot be set excessively low; otherwise, the performance for shaving beard or shaving feeling would be deteriorated. For this reason, it is difficult to set the pressing force of the cutter circumferential rims to an adequately small value.

Further, according to the shaving apparatus disclosed in JP 9-503424(T) (corresponding to WO 96/02368, U.S. Pat. No. 5,625,950, and EP 0719203), the outer cutter and the rim are reset to their stationary positions by the force of the inner cutter drive shaft to restore to an upright position. Since the inner cutter drive shaft is normally vertical, the outer cutter will normally restore to a horizontal position. This presents a problem in that the inclination of the outer cutter at the stationary position cannot be arbitrarily set. There is another problem in that the inclinable range of the cutter circumferential rim is restricted.

According to the shaving apparatus disclosed in JP 2007-151925(A) (corresponding to US 2007-124936(A1)), the upright wall of the upper surface of the shaver main body is exposed between adjoining cutter circumferential rims. This causes a problem such that the head assembly becomes inevitably larger, and shaving debris or beard trimmings easily adhere to the upper surface of the shaver main body, making it difficult to remove the debris.

The shaving apparatus disclosed in JP 2007-117190(A) (corresponding to US 2007-089298(A1) and EP 1779983A1) presents a problem in that the outer cutter frame surrounding a plurality of cutter units inevitably becomes large, resulting in a large head unit. The one disclosed in JP 2007-319339(A) (corresponding to US 2007-277379(A1) and EP 1862271A1) has a drawback in that the cutter unit tilts (or bends) together with the portion partitioned by the slit of the outer cutter frame, thus restricting the movement of the outer cutter and also preventing easy cleaning.

SUMMARY OF THE INVENTION

The present invention has been accomplished under the circumstances as aforementioned, and an object thereof is to provide a rotary electric shaver which is capable of enhancing the design freedom of the shape and placement of a cutter circumferential rim, accomplishing a reduced depressing force or an inclination start pressure of an outer cutter so as to allow the outer cutter to easily trace skin irregularities thereby to improve shaving feeling, permitting arbitrary setting of the tilt of the outer cutter in its stationary position according to user preference, expanding the inclinable range of the cutter circumferential rim, permitting a reduced size of a head unit, allowing the head unit to be easily cleaned, and enhancing the design freedom of a shaver surface.

According to the present invention, the aforesaid object is achieved by a rotary electric shaver which pivotably retains a plurality of outer cutters on a head bottom plate at the top of a shaver main body and rotatively drives inner cutters while bringing the inner cutters into resilient contact with inner surfaces of the outer cutters, the rotary electric shaver comprising:

a plurality of cutter circumferential rims, each which is detachable from the shaver main body, and separately surrounds and holds each of the outer cutters;

a pivotal supporting section which pivotably retains the respective cutter circumferential rims on a pivotal axis passing the center of the respective outer cutters; and a detachable blind cover which fills a gap between the cutter circumferential rims and which is in resilient contact, from below, with a bottom edge of the cutter circumferential rim, the bottom edge being adjacent to the center of the shaver main body.

The individual cutter circumferential rims are not joined to each other and pivotally move independently from each other, thus leading to less restriction on the shape and placement of the cutter circumferential rims. This allows the shape and placement of the cutter circumferential rims to be determined relatively freely. Hence, the shape and placement of the cutter circumferential rims or the like can be determined according to, for example, design requirements.

Depressing or tilting one cutter circumferential rim requires the application of a depressing force which is larger than the resultant force of the upward force and the force of restoration from an inclination of a single inner cutter drive shaft associated with the cutter circumferential rim and an upward restoring force of the blind cover. The restoring force of the blind cover can be set to a sufficiently small value, and therefore the depressing start pressure or an inclination start pressure can be set to a sufficiently small value, thus making it possible to improve the traceability of the outer cutters relative to the skin with resultant better shaving feeling. At this time, the blind cover has already started to descend, so that the remaining cutter circumferential rims will be subjected to the upward force of one inner cutter which is in sliding contact with the outer cutter, thus requiring a relatively small depressing force for the remaining cutter circumferential rims to descend and tilt. With this arrangement, adjoining cutter circumferential rims will be easily depressed when a head unit is slid on the skin, and smooth movement can be achieved, leading to improved shaving feeling.

Here, each of the cutter circumferential rims has a blind cover upwardly engaged therewith, so that the cutter circumferential rim restores to its stationary position by the force of restoration to an upright position of the inner cutter drive shaft and an upward force of the blind cover. Therefore, the inclination of the outer cutter can be arbitrarily set by appropriately setting the upward force of the blind cover. For example, the upper surface of the outer cutter can be inclined outward in its stationary mode. Moreover, the inclinable range of the cutter circumferential rims can be expanded.

Furthermore, there is no need to provide the upper surface of the shaver main body (the head bottom plate) with a wall, namely, an upright wall, which surrounds the cutter circumferential rim, thus permitting a reduced size of the head unit. Further, since the upright wall is unnecessary and gaps among the cutter circumferential rims are covered by the blind cover, the chances of entry of shaving debris from thereunder are minimized and the detachable designs of the cutter circumferential rims and the blind cover permit easy removal of shaving debris.

Preferably, the outer cutters are disposed at equal intervals in a circumferential direction around the center of the shaver main body (head), as observed in a top plan view, and each of the cutter circumferential rims is held on a straight line (pivotal axis) which is orthogonal to a straight line in a radial direction passing the center of the shaver main body and the center of the outer cutter and which also passes the center of the outer cutter, as observed in a top plan view, while the blind cover is held at the center of the shaver main body (head). In this case, the upward forces applied to the plurality of outer cutters will be equal and every outer cutter will share the same condition of use, thus providing excellent shaving feeling.

Preferably, the blind cover is retained at the center of the main body such that the blind cover is movable in the vertical direction within a predetermined range and also free to move in an inclining direction, while being provided with an upward restoring tendency by a spring or the like. In this case, for example, a depressing force applied to one cutter circumferential rim causes the blind cover to descend while tilting, leading to improved traceability of the blind cover relative to the cutter circumferential rim.

Preferably, the blind cover comprises a cylindrical pillar locked by a clicking mechanism or a snapping mechanism onto a cover mounting shaft rising from the center of the head bottom plate, a coil spring is accommodated in the pillar, and a coil spring is abutted against the upper end of the cover mounting shaft thereby to impart the upward restoring force to the blind cover. By setting the coil spring to a sufficiently low tension, the depressing force (descending start pressure) or the inclination start pressure of the cutter circumferential rims can be controlled to a sufficiently small value, permitting further improved shaving feeling.

The blind cover preferably has a shape which extends out from the center of the main body in the radial direction via the gap between adjoining cutter circumferential rims. This makes it possible to minimize the size of the blind cover with a consequent reduced weight, permitting further improved traceability relative to the vertical movements of the cutter circumferential rims.

Figure 6A:
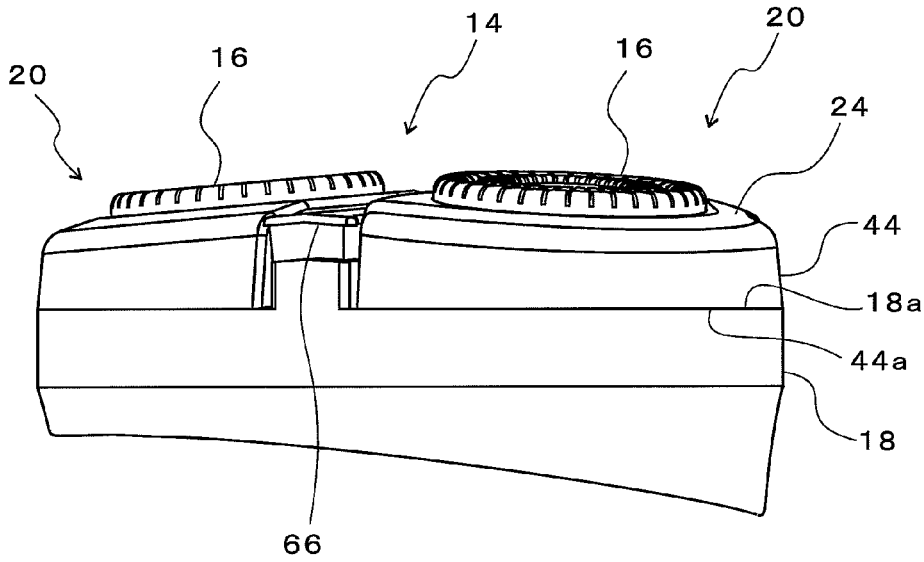
Figure 6B:
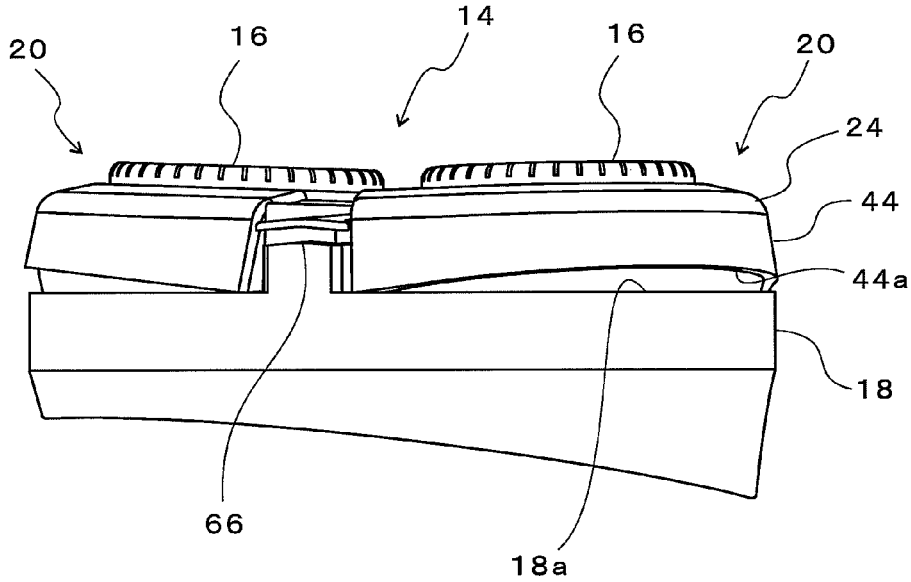
Figure 7A:
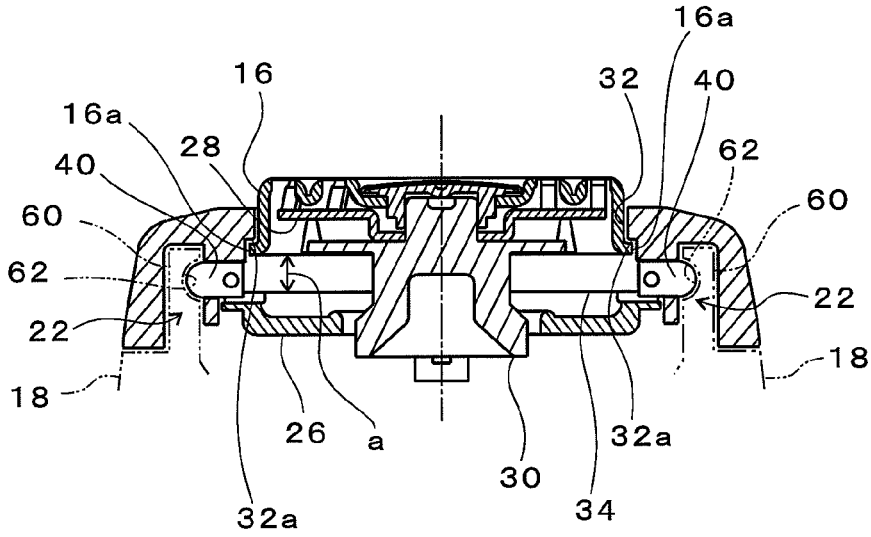
Figure 7B:
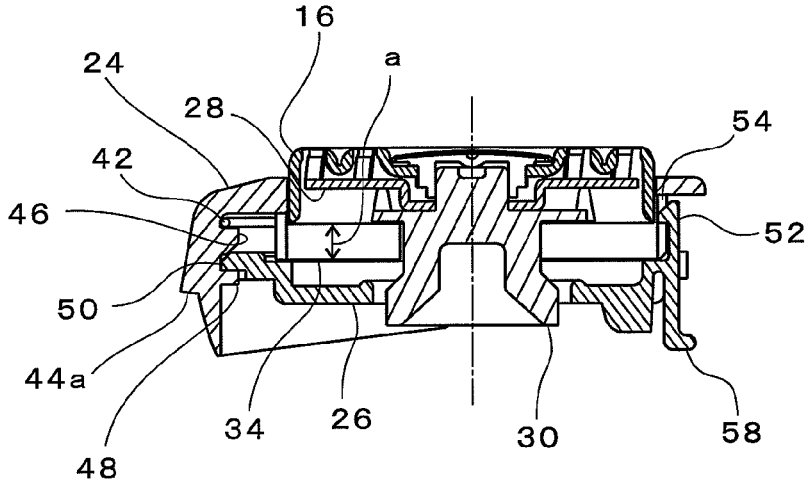
Figure 8A:
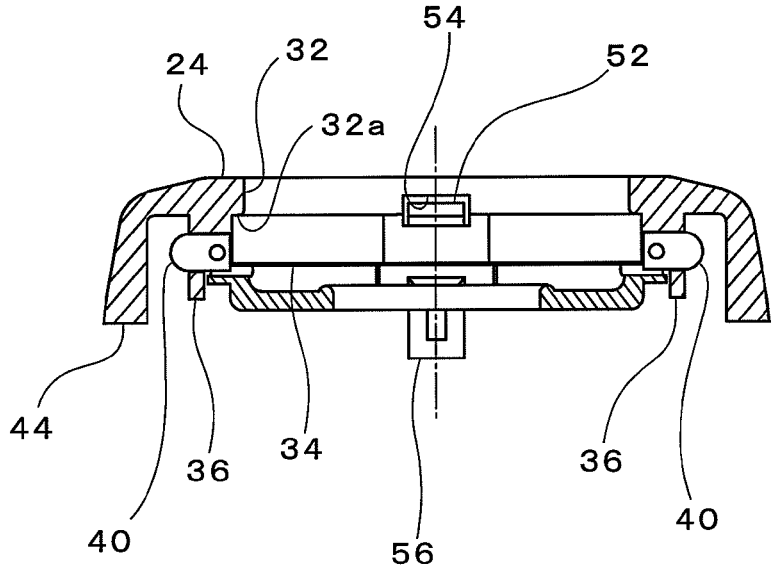
Figure 8B:
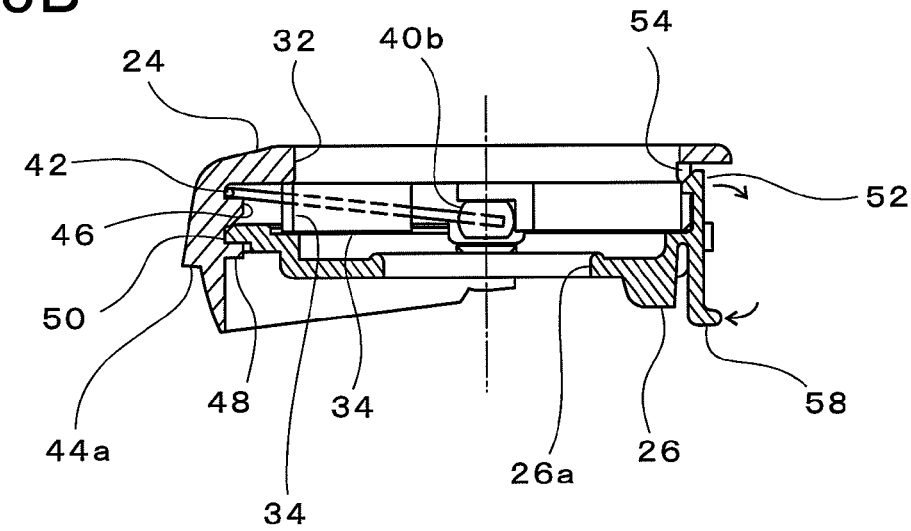
Figure 9A:
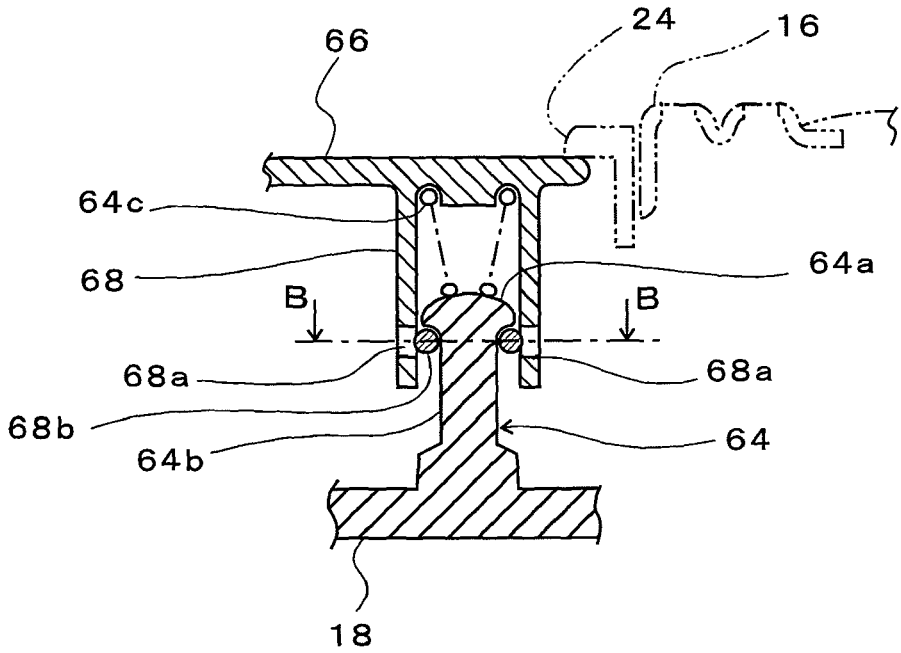
Figure 9B:
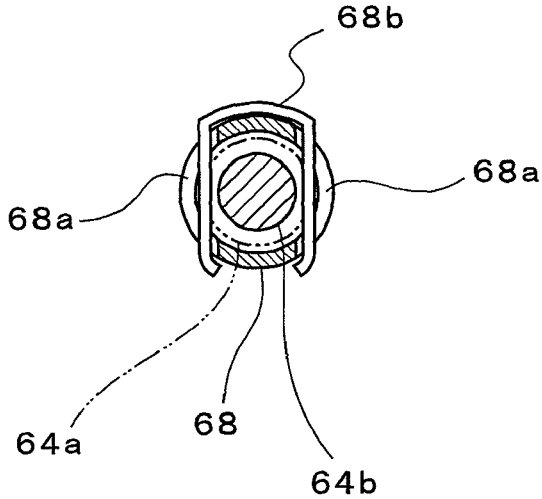

5B illustrating the cutter assembly from which the outer cutter, the inner cutter, and the cutter retaining plate have been all removed;

FIGS. 6A and 6B are side views of the head unit, FIG. 6A illustrating the head unit in a stationary state (a normal standby mode), and FIG. 6B illustrating the head unit, which has been tilted inward when a neighborhood of the center of the head unit has been depressed (an in-use mode);

FIGS. 7A and 7B are sectional side views of the cutter assembly, FIG. 7A illustrating a section which includes a pivotal axis C, and FIG. 7B illustrating a section which is orthogonal thereto;

FIGS. 8A and 8B are sectional side views of the cutter assembly with the inner cutter removed therefrom, FIG. 8A illustrating a section which includes a pivotal axis C, and FIG. 8B illustrating a section which is orthogonal thereto; and FIG. 9A is a sectional side view of a blind cover mounting section, and FIG. 9B is a sectional top view of the blind cover mounting section taken at line B-B in FIG. 9A.

DESCRIPTION OF THE PREFERRED EMBODIMENTS

First Embodiment

Figure 1:
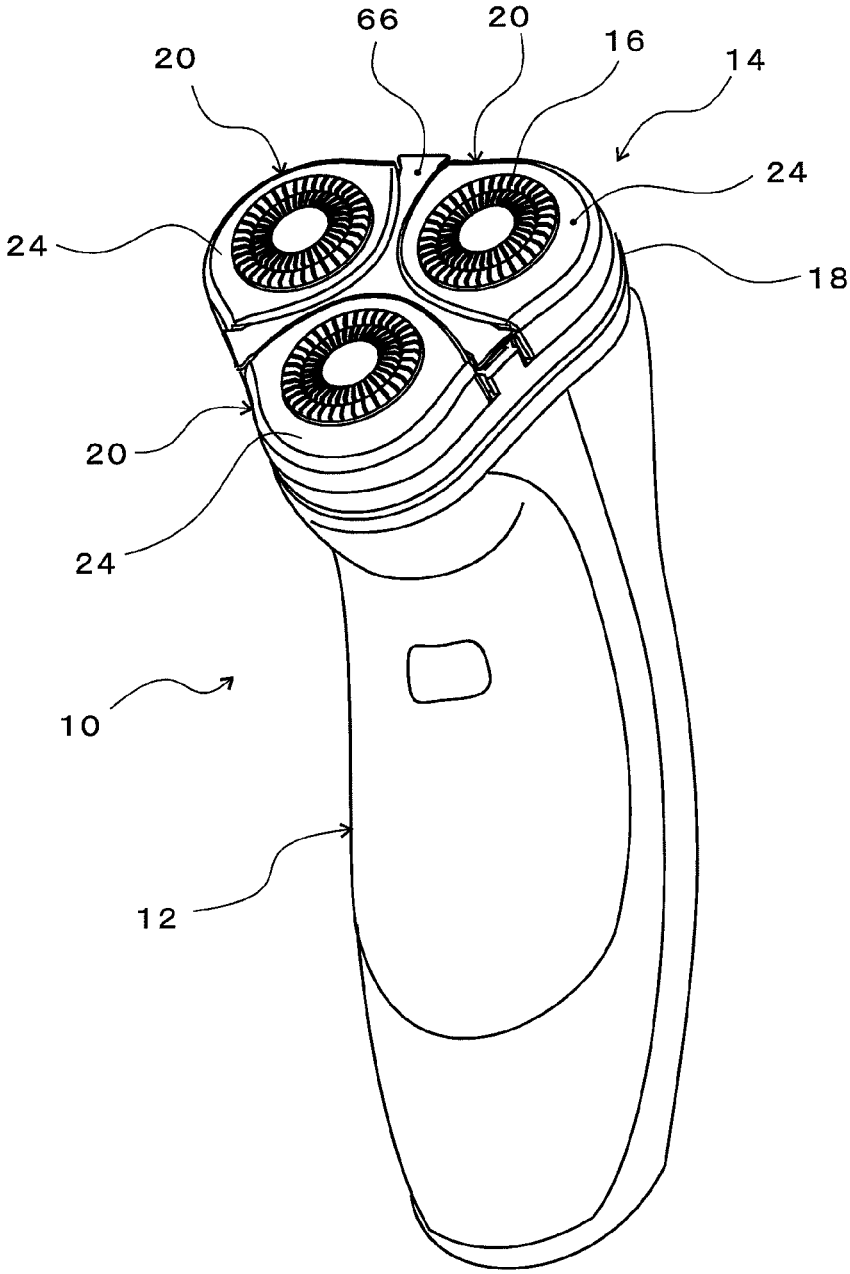
FIG. 1 is a view of a rotary electric shaver, which is an embodiment of the present invention.

Referring to FIG. 1, a rotary electric shaver 10 combines a main body 12 and a head unit 14, which is mounted on the upper surface of the main body 12, into one piece. The main body 12 mainly accommodates an electric motor, a battery, and a control circuit (none of them being shown). The head unit 14 has three outer cutters 16 disposed on an equilateral-triangular apexes. Three cutter assemblies 20 are detachably retained on a head bottom plate 18, which provides the upper surface of the main body 12, such that the three cutter assemblies 20 are disposed equidistantly (at 120-degree intervals) relative to a center P of the head unit 14.

Figure 2A:
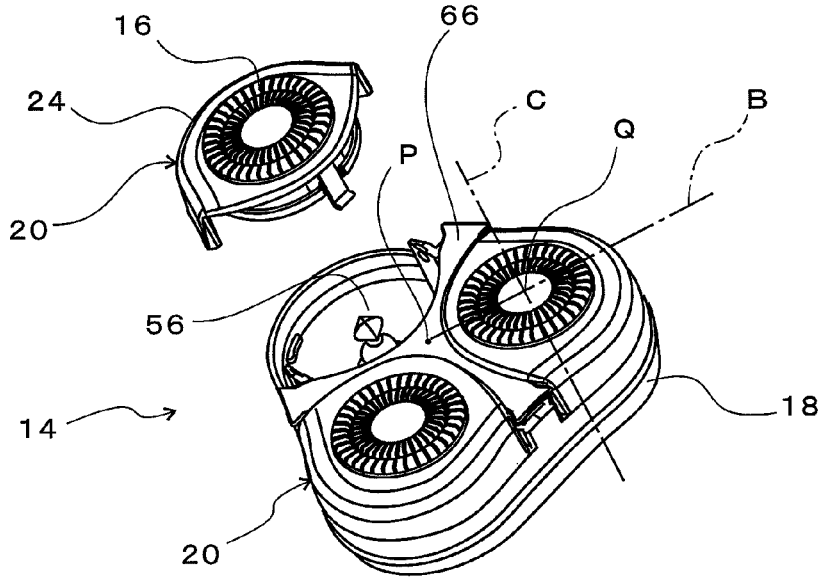
FIGS. 2A and 2B are exploded perspective views of a head unit of the rotary electric shaver in FIG. 1, FIG. 2A illustrating the head unit with one cutter assembly removed, and FIG. 2B illustrating the head unit with all cutter assemblies removed.

Each of the cutter assemblies 20 is pivotable about a straight line (pivotal axis) C which is orthogonal to a straight line B in a radial direction passing a center P (FIG. 2) of the head unit 14 and which passes a center Q of the outer cutter 16. In other words, each of the three cutter assemblies 20 is independently supported by pivotal supporting sections 22 (refer to FIG. 7A) and pivotally moves about its pivotal axis C.

Figure 3:
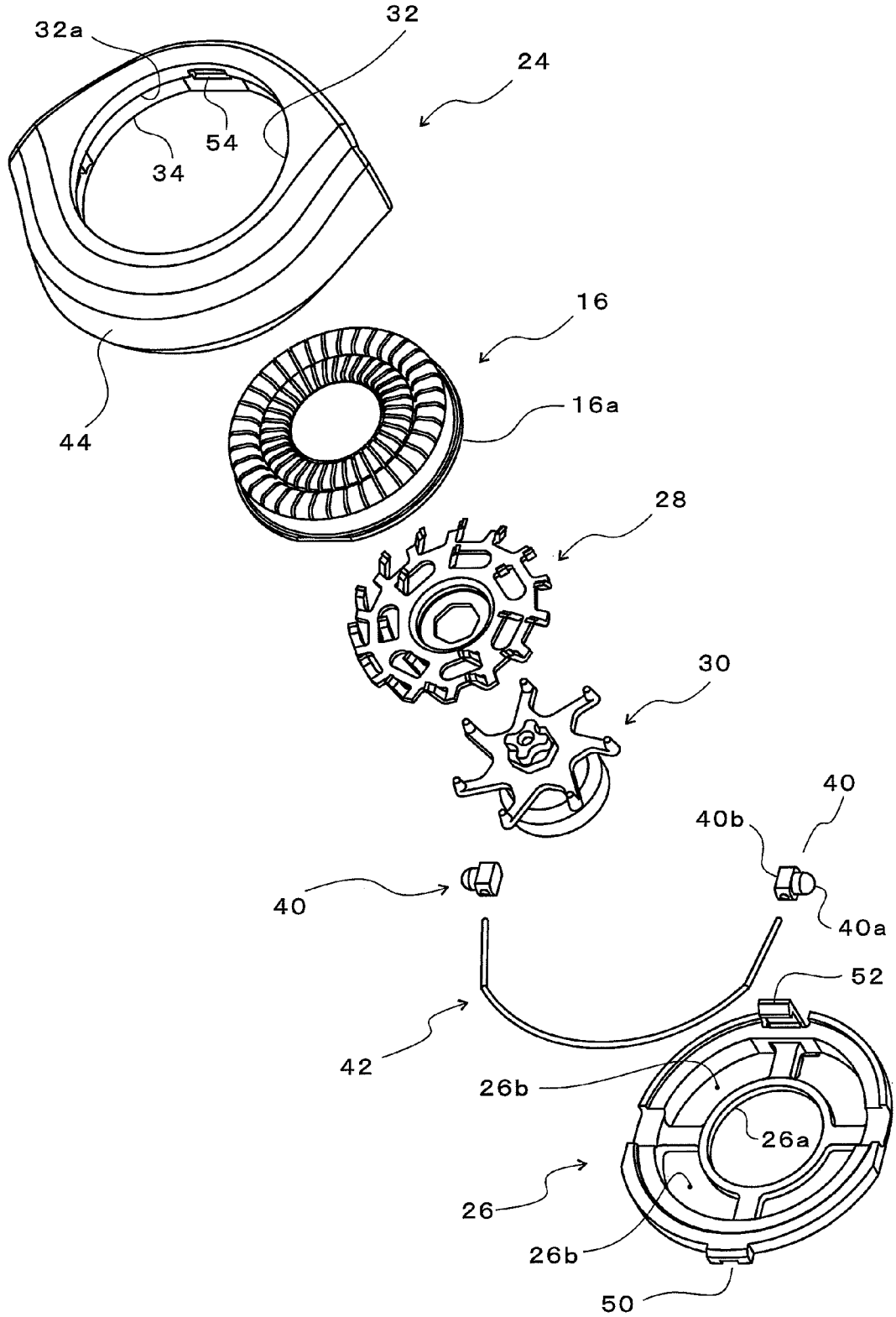
FIG. 3 is an exploded perspective view of one cutter assembly which has been disassembled and observed aslant from above.
Figure 4:
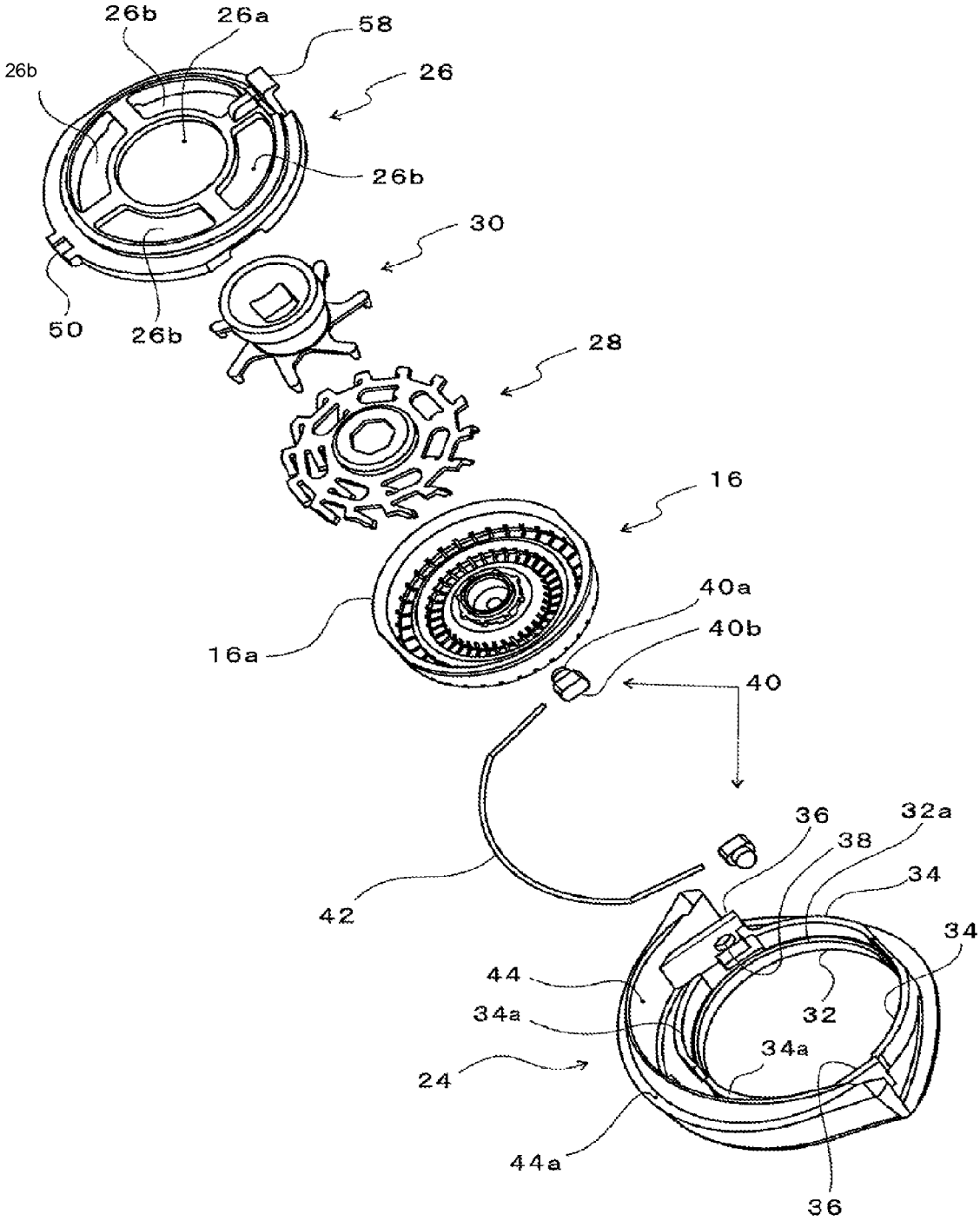
FIG. 4 is an exploded perspective view of one cutter assembly which has been disassembled and observed aslant from below.
Figure 5A:
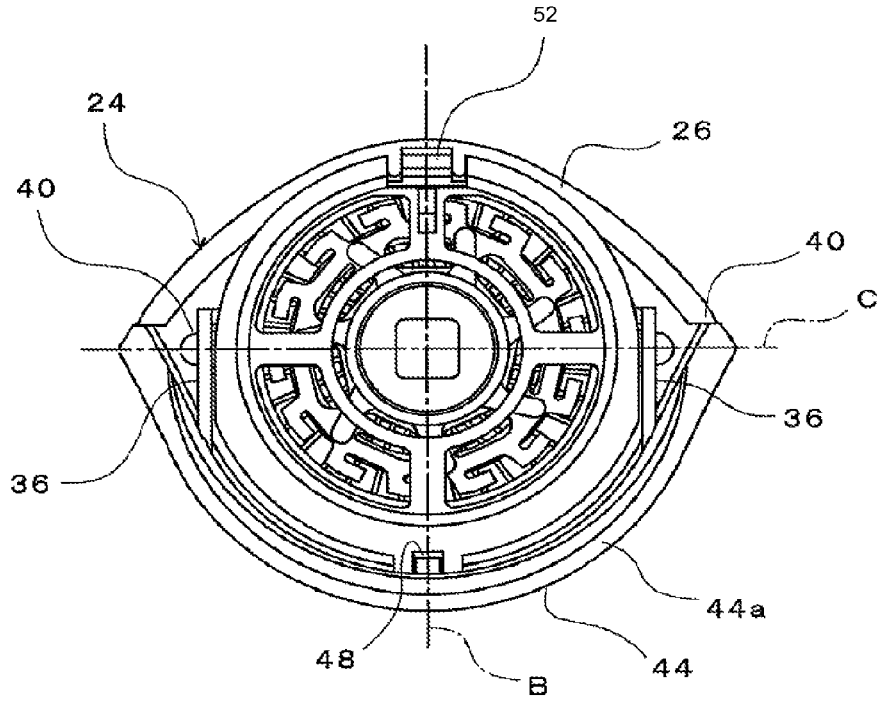
FIGS. 5A and 5B are bottom views of the cutter assembly, FIG. 5A illustrating an outer cutter, an inner cutter, and a cutter retaining plate, which have been assembled, and FIG.

As illustrated in FIGS. 3 and 4, the cutter assembly 20 comprises the outer cutter 16 shaped approximately like an inverted cup, an cutter circumferential rim (serving as a cutting member frame and also as a skin protection rim) 24 which holds the outer cutter 16, a cutter retaining plate 26 detachably secured to the cutter circumferential rim 24 from below, an inner cutter 28 accommodated between the outer cutter 16 and the cutter retaining plate 26, and an inner cutter shaft 30 made integral with the inner cutter 28. The cutter circumferential rim 24 has a circular opening 32 through which the outer cutter 16 passes from below. Four divided arcuate guide walls 34 and 34*a*, which have a slightly larger diameter than that of the opening 32 and are arranged in the circumferential direction, are protrusively provided on the inner lower surface of the cutter circumferential rim 24, as illustrated in FIGS. 4 and 5. A flange 16*a* (FIGS. 4 and 7A) provided on the opening rim of the outer cutter 16 engages a rim 32*a* of the opening 32 (FIG. 4) from below, thus restricting an upward escape of the outer cutter 16 from the cutter circumferential rim 24. The outer cutter 16 is vertically movable within a range of the heights of the guide walls 34, which guide the flange 16*a* (the range denoted by "a" in FIGS. 7A and 7B).

Figure 5B:
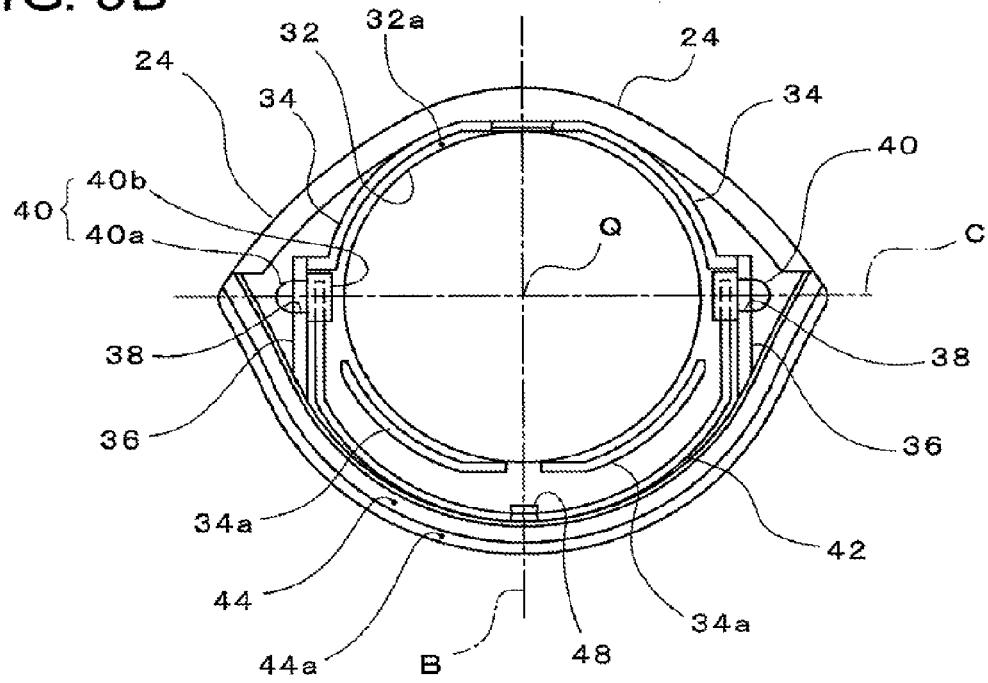

The cutter assembly 20 will now be described with reference to FIGS. 5B and 8A. On the lower surface of the cutter circumferential rim 24, a pair of upright walls 36, 36 is formed at positions where opposing portions of the guide walls 34, 34, which oppose each other with the pivotal axis C therebetween, are expanded in the direction of the pivotal axis C. Each of these upright walls 36 has a small aperture 38 positioned on the pivotal axis C (FIGS. 5 and 8). Projections 40*a* of pivotable axial members 40 penetrate these apertures 38 from the inside of the opening 32. The projections 40*a* have semispherical distal ends, and only the distal portions jut out to the outside from the apertures 38 of the upright walls 36. Inside proximal portions 40*b* of the pivotable axial members 40 have a diameter which is larger than that of the apertures 38. The proximal portions 40*b* abut against the upright walls 36, thereby defining the protrusion amounts of the projections 40*a* in the outward direction. Both ends of a wire spring 42, which is substantially arcuate, are secured to the proximal portions 40*b* of the pair of right and left pivotable axial members 40, 40 on the inside diameter side, thereby imparting the outward restoring tendency.

The cutter circumferential rim 24 is provided with another pair of guide walls 34*a*, 34*a* on the opposite side from the guide walls 34, 34, sandwiching the pivotal axis C therebetween. A semicircular descent wall 44 is formed on the outer side of the guide walls 34*a*, 34*a* to surround the guide walls 34*a*, 34*a*. Both ends of the descent wall 44 extend out to cover the outer sides of the upright walls 36, 36 (refer to FIG. 4). The wire spring 42 is retained on the inner surface of the descent wall 44 by engaging a central portion thereof with a projecting first stopper 46 provided on the inner surface of the descent wall 44 (refer to FIG. 7B and FIG. 8B). Thus, both ends of the wire spring 42 are secured by being fitted in the proximal portions 40*b* of the pivotable axial members 40. The wire spring 42 imparts a restoring force which pushes the projections 40*a*, 40*a* of the pivotable axial members 40, 40 outward.

As illustrated in FIGS. 3 and 4, the inner cutter 28 and the inner cutter shaft 30 are set in the outer cutter 16 from below the cutter circumferential rim 24 and then the cutter retaining plate 26 is attached to the cutter circumferential rim 24. The cutter retaining plate 26 has an inner opening 26*a* at the center thereof through which a lower portion of the inner cutter shaft 30 passes, and outer openings 26*b* which surround the inner opening 26*a* and which let beard trimmings or shaving debris fall therethrough. The outer periphery of the cutter retaining plate 26 is provided with a lug 50, which engages a projecting second stopper 48 formed in the descent wall 44 of the cutter circumferential rim 24, and an attaching/detaching hook 52 positioned on the opposite side from the lug 50.

As illustrated in FIGS. 7B and 8B, the cutter retaining plate 26 is fixed by first engaging the lug 50 with the second stopper 48 and then engaging the upper end of the hook 52 with an engaging aperture 54 provided in the guide wall 34 in a state the upper surface in the vicinity of the outer periphery of the cutter retaining plate 26 is abutted against an end surface of the guide wall 34 of the cutter circumferential rim 24 from below. The hook 52 has an operating end 58 formed as an integral portion thereof. By pushing the operating end 58 into the inside, the upper end of the hook 52 is disengaged from the engaging aperture 54, thus allowing the cutter retaining plate 26 to be released from the cutter circumferential rim 24.

The cutter assembly 20 constructed as described above is detachably mounted on the head bottom plate 18 of the main body 10 by the pivotal supporting sections 22. More specifically, three inner cutter drive shafts 56 projected from the head bottom plate 18, and a pair of pillars 60 is installed in a protruding manner on the pivotal axis C of each of the three cutter assemblies 20, each of the inner cutter drive shafts 56 being held therebetween (refer to FIG. 2(B)). Each of the pillars 60 has an engaging recess 62 with or from which the pivotable axial member 40 of the cutter assembly 20 engages or disengages. The engaging recess 62 may alternatively be a through hole and may have any shape as long as the shape allows the projection 40*a* at the distal end of the pivotable axial member 40 to engage therewith or disengage therefrom.

Figure 2B:
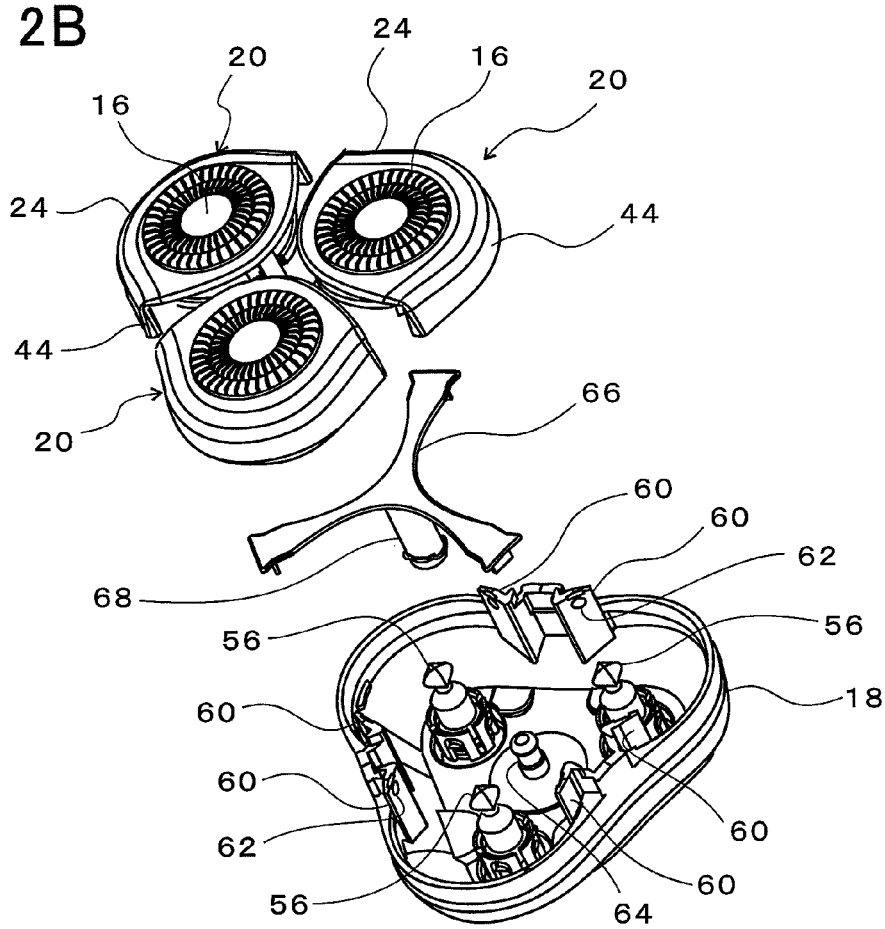

A blind cover mounting shaft 64 projects out at the center of the head bottom plate 18 of the shaver main body 10, and a trifurcate blind cover 66 is detachably installed onto the blind cover mounting shaft 64 (FIG. 2B). More specifically, a cylindrical pillar 68, which is to be snapped onto the blind cover mounting shaft 64, projects at the center of the bottom surface of the blind cover 66. Pushing the pillar 68 down to fit it onto the outer periphery of the cover mounting shaft 64 by snapping or clicking secures the trifurcate blind cover 66 in place. The pillar 68 includes a coil spring 64*c* therein (FIG. 9A), which imparts an upward restoring tendency to the cover 66 when the blind cover 66 is secured onto the cover mounting shaft 64. Each extended arm end of the blind cover 66 in the direction of the outer periphery is locked between the adjacent pillars 60, 60 of the head bottom plate 18 (refer to FIG. 7B).

Here, the mounting section of the blind cover 66 will be described in detail. As illustrated in FIG. 9A, the blind cover mounting shaft 64 has a smaller-diameter portion 64*b* beneath an upper end portion 64*a*. The inside diameter of the cylindrical pillar 68 is set such that the upper end portion 64*a* of the mounting shaft 64 is free to be slidable therein. A pair of slits 68*a*, 68*a*, which extends in the circumferential direction, is formed, with the central axis of the pillar 68 sandwiched therebetween, in the lower outer periphery of the pillar 68. A clip 68*b* made of an approximately U-shaped wire spring is installed in the slits 68*a*, 68*a*.

The pillar 68 is joined to the mounting shaft 64, the coil spring 64*c* being installed between the inner bottom of the pillar 68 and the upper end portion 64*a* of the mounting shaft 64. More specifically, aligning the bottom end of the pillar 68 to the upper end portion 64*a* of the mounting shaft 64 and then pushing the bottom end of the pillar 68 downward causes the clip 68*b* to be pushed open once by the upper end portion 64*a* of the mounting shaft 64, thus engaging the clip 68*b* with the smaller-diameter portion 64*b*. As a result, the blind cover 66 is free to move (vertically movable and also inclinable) within the range of the vertical dimension of the smaller-diameter portion 64*b* and is provided with an upward restoring tendency by the coil spring 64*c*. Further, the clip 68*b* abuts against the bottom edge of the upper end portion 64*a* from the side of the smaller-diameter portion 64*b*, thereby restricting the upward movable range of the blind cover 66. This state is illustrated in FIG. 9A.

After attaching the cover 66 to the head bottom plate 18, the cutter assembly 20 is detachably installed onto the pillars 60 with a click. More specifically, the lower end of the inner cutter shaft 30 is aligned with the inner cutter drive shaft 56 while setting the descent wall 44 of the cutter circumferential rim 24 of the cutter assembly 20 along the outer periphery of the head bottom plate 18. An upward restoring tendency is imparted to the polygonal (rectangular) engaging head of the inner cutter drive shaft 56 by a coil spring (not shown) built in the inner cutter drive shaft 56. The lower end of the inner cutter shaft 30 has an engaging recess in which the engaging head of the drive shaft 56 is locked. With such arrangement, by pushing the cutter assembly 20 downward, the inner cutter 28 comes in an upward resilient contact with the outer cutter 16 by the restoring force of the inner cutter drive shaft 56.

When the cutter assembly 20 is further pushed downward against the restoring force, the distal projection 40*a* of the pivotable axial member 40 attached to the cutter circumferential rim 24 comes in contact with the upper edge of the pillar 60 of the head bottom plate 18 and to be pushed in against the wire spring 42 until the projection 40*a* engages with the engaging recess 62 of the pillar 60 with a snap or a click. In this state, the cutter assembly 20 pivotally moves about the pivotable axial member 40, i.e., the pivotal axis C.

The restoring force of the coil spring built in the inner cutter drive shaft 56 is applied to the outer cutter 16 and the cutter circumferential rim 24 upward through the intermediary of the inner cutter 28. The upward restoring force of the inner cutter drive shaft 56 acts on the pivotal axis C of the cutter circumferential rim 24 (FIGS. 5 and 7), so that the upward restoring force is considered hardly effective for the cutter circumferential rim 24 to restore from an inclination. Meanwhile, the blind cover 66 is urged upward by the coil spring 64*c* in the pillar 68, and the bottom surface of the cutter circumferential rim 24, which bottom surface is adjacent to the center P of the head unit 14, abuts against the blind cover 66 (FIG. 9A). Thus, the cutter assembly 20 becomes still and stable in the state illustrated in FIG. 6A. At this time, a stepped portion 44*a* provided on the outer peripheral surface of the descent wall 44 of the cutter circumferential rim 24 (refer to FIGS. 6, 7B, and 8B) abuts against a peripheral upper edge 18*a* of the head bottom plate 18 to position the cutter assembly 20.

With the three cutter assemblies 20 installed, pressing the central area of the head unit 14 against the skin to be shaved causes the cutter assemblies 20 to go down at the center of the head unit 14. In other words, the central portion of the head unit 14 goes down about the pivotal axis C (the state illustrated in FIG. 6B). The upper surface of the cutter circumferential rim 24 is long (wide) in the direction of the pivotal axis C and short (narrow) in the direction orthogonal thereto. The cutter circumferential rim 24 pivotally and vertically moves in the direction orthogonal to the pivotal axis C, so that the pivotal movement of the cutter circumferential rim 24 and the descent of the outer cutter 16 prevent the contact pressure applied by the upper surface of the cutter circumferential rim 24 and the outer cutter 16 to skin from becoming excessive. This secures protection of skin.

On the other hand, the cutter circumferential rim 24 does not pivotally move in the direction orthogonal to the pivotal axis C, so that the contact pressure on the skin on the pivotal axis will be absorbed only by the vertical movement of the outer cutter 16 relative to the cutter circumferential rim 24, leading to a possibility of inadequate absorption of the contact pressure. However, the upper surface of the cutter circumferential rim 24 expands out over the pivotal supporting sections 22, that is, expands in the direction of the pivotal axis C; therefore, the area of contact with the skin in the direction of the pivotal axis C is increased. This leads to a lower pressure of contact (the contact pressure per unit area) between the skin and the outer cutters, thus enhancing the protective effect for skin.

The pivotal supporting sections 22 supporting the cutter circumferential rim 24 is not located between the cutter circumferential rim 24 and the head bottom plate 18, which provides the outer cutter frame. Rather, the pivotal supporting section 22 is located under the cutter circumferential rim. This arrangement makes it possible to reduce the size of the head bottom plate 18 and minimize the chances of shaving debris adhering to the pivotal supporting sections 22. Furthermore, each of the cutter assemblies 20 is detachably installed to the main body 10, permitting easy cleaning of the head unit 14.

The cutter circumferential rims 24 of the three cutter assemblies 20 are in the state illustrated in FIG. 6A, the portions thereof adjacent to the center of the main body (head unit) being pushed up by the blind cover 66. Pushing down only one cutter circumferential rim 24 causes the blind cover 66 to descend also. Accordingly, when the head unit 14 is moved along a skin surface to be shaved, the adjacent cutter circumferential rims 24 can be depressed and inclined with an extremely small depressing force, since the blind cover 66 have already been down. This arrangement permits smooth movement of the head unit 14 and leads to improved shaving feeling.

In addition, since the blind cover 66 pushes up the cutter circumferential rims 24, the angles of the upper surfaces of the outer cutters 16 in the stationary (normal standby) mode can be set such that the outer cutters 16 are inclined outward, as illustrated in FIG. 6A, rather than being restricted only to the setting by a restoring force for the inner cutter drive shaft to its upright position. This arrangement allows the movable and inclinable range of the outer cutters to be expanded.

The invention claimed is:

1. A rotary electric shaver which is provided with a shaver main body and a head bottom plate disposed at a top of the shaver main body, the head bottom plate is coupled to a plurality of cutter assemblies dispose thereon, each of the plurality of cutter assemblies pivotally hold a respective one of a plurality of outer cutters and a plurality of inner cutters disposed therein, a plurality of inner cutter drive shafts projected from the head bottom plate are configured to engage a respective one of the plurality of inner cutters and rotatively drive the plurality of inner cutters while bringing the plurality of inner cutters into resilient contact with inner surfaces of the plurality of outer cutters, the rotary electric shaver comprising:

a plurality of cutter circumferential rims, wherein each of the plurality of cutter circumferential rims is detachable from the shaver main body and has an opening, and each of the plurality of cutter circumferential rims separately surrounds a respective one of the plurality of outer cutters to support the respective one of the plurality of the outer cutters in the opening;

a plurality of pivotal supporting sections which each of the plurality of pivotal supporting sections pivotally retains a respective one of the plurality of cutter circumferential rims on a pivotal axis which passes a center of the respective one of the plurality of outer cutters; and a detachable blind cover which fills a gap between the plurality of cutter circumferential rims, and the blind cover is in resilient contact, from below, with bottom edges of the plurality of cutter circumferential rims, the bottom edges being adjacent to a center vertical axis of the shaver main body.

2. The rotary electric shaver according to claim 1, wherein the plurality of the outer cutters are disposed at equal intervals in a circumferential direction around the center of the shaver main body, as observed in a top plan view, each of the plurality of cutter circumferential rims is retained on a pivotal axis on which each of the plurality of cutter circumferential rims pivots, wherein the pivotal axis passes through the center of the outer cutter and is orthogonal to a straight line which extends in a radial direction that passes through the center vertical axis of the shaver main body and the center of the outer cutter, as observed in a top plan view, and the blind cover is coupled to a blind cover mounting shaft which projects out of the head bottom plate at the center vertical axis of the shaver main body.

3. The rotary electric shaver according to claim 1, wherein the blind cover is retained on a mounting shaft that projects from the head bottom plate at the center vertical axis, and the blind cover is retained on the mounting shaft such that the blind cover is free to move in a vertical direction and a tilting direction on the mounting shaft within a predetermined range and is also provided with an upward restoring tendency.

4. The rotary electric shaver according to claim 3, wherein the blind cover comprises a hollow cylindrical pillar which extends from a bottom surface of the blind cover and is configured to accept the mounting shaft therein, wherein the cylindrical pillar is locked onto the mounting shaft by a locking mechanism coupled to the cylindrical pillar, and a coil spring which is placed on the bottom surface of the blind cover and abuts against an upper end of the mounting shaft.

5. The rotary electric shaver according to claim 3, wherein a spring is disposed between an upper portion of the mounting shaft and a bottom surface of the blind cover, and the spring provides the upward restoring tendency such that the blind cover is in resilient contact, from below, with the bottom edges of the plurality of cutter circumferential rims.

6. The rotary electric shaver according to claim 1, wherein the blind cover extends out from the center vertical axis of the shaver main body in a radial direction via the gap between adjoining cutter circumferential rims of the plurality of cutter circumferential rims.

7. The rotary electric shaver according to claim 1, wherein the detachable blind cover comprises an upper surface which is in resilient contact, from below, with the bottom edges of the plurality of cutter circumferential rims.

8. The rotary electric shaver according to claim 7, wherein the upper surface is in resilient contact, from below, with the bottom edges of the plurality of cutter circumferential rims such that the upper surface is constantly exerting an upward force on the bottom edges of the plurality of cutter circumferential rims.

* * * * *